US007190916B2

(12) United States Patent
Yoshizawa

(10) Patent No.: US 7,190,916 B2
(45) Date of Patent: Mar. 13, 2007

(54) IMAGE FORMING APPARATUS

(75) Inventor: Ryuichi Yoshizawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 10/790,739

(22) Filed: Mar. 3, 2004

(65) Prior Publication Data

US 2004/0247336 A1 Dec. 9, 2004

(30) Foreign Application Priority Data

Mar. 5, 2003 (JP) ..... 2003-058724

(51) Int. Cl.
*G03G 21/00* (2006.01)

(52) U.S. Cl. ..... 399/82; 399/77

(58) Field of Classification Search ..... 399/82, 399/85, 87, 76, 77, 78
See application file for complete search history.

(56) References Cited

U.S. PATENT DOCUMENTS 6,122,464 A * 9/2000 Kakigi ..... 399/82
6,266,151 B1 7/2001 Tachibana et al. ..... 358/1.4
6,301,452 B1 10/2001 Yoshizawa ..... 399/45
6,347,203 B1 * 2/2002 Kutsuwada ..... 399/82
6,393,232 B1 * 5/2002 Osari et al. ..... 399/82
6,738,587 B1 * 5/2004 Hoene et al. ..... 399/77

FOREIGN PATENT DOCUMENTS

JP 2001-88370 4/2001

* cited by examiner

*Primary Examiner*—Louis Arana
(74) *Attorney, Agent, or Firm*—Fitzpatrick, Cella, Harper & Scinto

(57) ABSTRACT

An engine control part determines a print operation start timing, wherein a transferring material discharging interval designated by a transferring material discharging interval notifying means for notifying a controller part of the transferring material discharging interval till the transferring material can be received when a transferring material discharging schedule operation means makes a schedule of a transferring material discharging operation for a transferring material discharging option control part, is set as a transferring material discharging interval from the transferring material discharged by a transferring material discharging option last time. A futile downtime is eliminated by virtue of processing of an discharging option such as changeover of discharging bins, stapling, bookbinding, etc. even in a case where an interval between transferring materials is expanded wider than normal.

19 Claims, 13 Drawing Sheets

FIG. 5

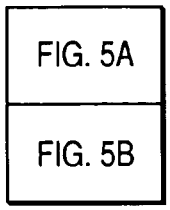

FIG. 5A

START

S501 IS PRINT START COMMAND RECEIVED ? (NO / YES)

B

S502 INITIAL ROTATION SEQUENCE

C

S503 OUTPUT TOP SIGNAL AND PRINT

S504 NEXT TIMING OF NORMAL PRINT START ? (NO / YES)

S505 IS PRINTING SCHEDULED ? (NO / YES)

S516 POST-ROTATION SEQUENCE → END

S506 IS DISCHARGING INTERVAL DESIGNATION COMMAND DESIGNATED TO NEXT SCHEDULED PRINT ? (NO / YES)

A

S513 IS SUPPLYING INTERVAL DESIGNATION COMMAND DESIGNATED TO NEXT SCHEDULED PRINT ? (NO / YES (SUPPLYING INTERVAL DESTINATION COMMAND ONLY))

S514 TIME TO START SUPPLY OF TRANSFERRING MATERIAL FROM THE PREVIOUS SUPPLYING OPTION ≧ SUPPLYING INTERVAL TIME ? (NO / YES)

D

IMAGE FORMING APPARATUS

BACKGROUND OF THE INVENTION

1. Field of the Invention

The present invention relates to an image forming apparatus such as copying machines, printers, etc. of an electrophotographic system and of an electrostatic storage system.

2. Related Background Art

A conventional image forming apparatus will be explained with reference to FIG. 6.

FIG. 6 is a schematic side view showing an entire printer defined as the conventional image forming apparatus. This printer is constructed so that the image forming section forms electrostatic latent images by light of images formed based on image signals transmitted from an unillustrated controller part, and then forms color visible images by developing the electrostatic latent images and transferring visible images in superposition. The color visible images are transferred onto a transferring material (a material for recording) such as a recording sheet, etc., and the color visible images on the transferring material are fixed by a fixing section.

Referring to FIG. 6, the symbol P represents a printer, the numeral 1 designates a transferring material (recording material) housing cassette (containing cassette), and the numeral 2 denotes the transferring material. The transferring material housing cassette 1 houses plural sheets of transferring materials. The numeral 3 stands for an image forming part constructed of photosensitive bodies 4Y, 4M, 4C, 4K provided with respective stations side by side for development colors (yellow (Y), magenta (M), cyan (C), black (K)), injection chargers 5Y, 5M, 5C, 5K serving as primary charging means, developing units 6Y, 6M, 6C, 6K serving as developing means, toner cartridges 7Y, 7M, 7C, 7K, an intermediate transferring body 8, a sheet feeding section, a transferring section and a fixing section 9.

The photosensitive bodies 4Y, 4M, 4C, 4K, the injection chargers 5Y, 5M, 5C, 5K and the developing units 6Y, 6M, 6C, 6K are mounted in process cartridges 10Y, 10M, 10C, 10K detachably attached to a body of the image forming apparatus.

The photosensitive bodies 4Y, 4M, 4C, 4K each taking a drum-like shape are constructed by coating organic photoconductive layers over outer peripheries of aluminum cylinders and are rotated by unillustrated drive motors. The drive motors rotate the photosensitive bodies 4Y, 4M, 4C, 4K counterclockwise in FIG. 6 in accordance with an image forming operation. Beams of light, to which the photosensitive bodies 4Y, 4M, 4C, 4K are exposed, are traveled from scanner parts 11Y, 11M, 11C, 11K, and surfaces of the photosensitive bodies 4Y, 4M, 4C, 4K are selectively exposed to the beams of light, thereby forming electrostatic latent images.

The primary charging means has a structure in which each station is provided with four pieces of injection chargers 5Y, 5M, 5C, 5K for electrifying the photosensitive bodies 4Y, 4M, 4C, 4K for yellow (Y), magenta (M), cyan (C) and black (K), and the respective injection chargers 5Y, 5M, 5C, 5K are provided with sleeves 5YS, 5MS, 5CS, 5KS.

The developing means has a structure in which each station is provided with four pieces of developing units 6Y, 6M, 6C, 6K for developing in yellow (Y), magenta (M), cyan (C) and black (K) in order to visualize the electrostatic latent images, and the respective developing units 6Y, 6M, 6C, 6K are provided with sleeves 6YS, 6MS, 6CS, 6KS. The developing units 6Y, 6M, 6C, 6K are detachably attached to the body of the image forming apparatus.

The intermediate transferring body 8 abuts the photosensitive bodies 4Y, 4M, 4C, 4K and, when forming color images, rotates clockwise in FIG. 6 as the photosensitive bodies 4Y, 4M, 4C, 4K make rotations, thus transferring the visible images onto the intermediate transferring body 8. Further, when forming the images, transferring rollers 12*a* which will be explained later on are brought into contact with the intermediate transferring body 8, whereby the transferring material 2 is conveyed while being nipped in between the transferring rollers 12*a* and the intermediate transferring body 8. The color visible images can be transferred in superposition onto the transferring material 2 and the intermediate transferring body 8, simultaneously.

The transferring rollers 12*a* abut intermediate transferring body 8 while transferring the color visible images in superposition onto the intermediate transferring body 8. When finishing the print processing, however, the transferring rollers 12*a* are shifted to positions 12*b* depicted by a broken line in FIG. 6, thus separating the transferring rollers 12*a* from the intermediate transferring body 8.

The fixing section 9 fixes the transferred color visible images onto the transferring material 2 while conveying the transferring material 2. The fixing section 9 includes fixing rollers 13 for heating the transferring material 2, and pressurizing rollers 14 for bringing the transferring material 2 into a press-contact with the fixing rollers 13. The fixing roller 13 and the pressurizing roller 14 are hollowed and are provided with heaters 15, 16 respectively in their interiors. Namely, the transferring material 2 bearing the color visible images is conveyed by the fixing rollers 13 and the pressurizing rollers 14 and is heated and pressurized, whereby the toners are fixed onto the surface of the transferring material 2.

The transferring material 2 is, after the visible images have been fixed onto the material 2, discharged to the outside of the apparatus from a discharging part, thereby finishing the image forming operation.

The printer P manages a conveying state of the transferring material by use of a lower-stage conveyance sensor 17, an upper-stage conveyance sensor 18, a lower-stage conveyance sensor 19, an upper-stage conveyance sensor 20, a registration sensor 21, a pre-fixing sensor 22, a fixing discharging sensor 23 and a discharging sensor 24, which are disposed on a transferring material conveying path.

The numeral represents a cleaning means for cleaning residual toners on the photosensitive bodies 4Y, 4M, 4C, 4K and on the intermediate transferring body 8. Waste toners after transferring onto the intermediate transferring body 8 the visible images formed by the toners on the photosensitive bodies 4Y, 4M, 4C, 4K or waste toners after transferring onto the transferring material 2 the four-color (Y, M, C, K) visible images formed on the intermediate transferring body 8, are accumulated in an unillustrated cleaner container.

The numeral 26 designates a discharging option including rollers 27, 28, 29, 30, a flapper 31, a first discharging bin 32, a second discharging bin 33, a third discharging bin 34 and a bin ascending/descending motor 35.

The discharging option 26 serves to sort out the transferring materials 2 by use of the first discharging bin 32, the second discharging bin 33 and third discharging bin 34 and to thus stack the materials 3 up. The discharging bins 32–34 are moved up and down by the bin ascending/descending motor 35, thereby sorting out the transferring materials 2 into the respective bins 32–34. The flapper 31 serves to change over the surface and the undersurface of the transferring material 2 fed to the discharging option 26 on the basis of an instruction given from the controller part. If a face-up designation is given from the controller part, the transferring material 2 is led to the rollers 27 and fed directly to the discharging port. Further, if a face-down designation is given from the controller part, the transferring material 2 is led by the flapper 31 to the rollers 28 and the rollers 29, and is conveyed till a trailing end of the transferring material 2 passes the rollers 28. Thereafter, the rollers 29 rotate reversely, and the transferring material 2 is fed in, with its trailing end headed, towards the rollers 30 and thus conveyed to the discharging port.

Note that the numeral 36 represents a density sensor, 37 designates a color deviation sensor, and 38 denotes a driving roller in FIG. 6.

FIG. 7 is a block diagram showing a system architecture of the printer P illustrated in FIG. 6. In FIG. 7, there are shown a host computer 200, a controller part 201, a discharging option control part 202 and an engine control part 203. The engine control part 203 includes a video interface part 204, a CPU (Central Processing Unit) 205, an image processing GA 206, an image control part 207, a fixing control part 208, a transferring material conveying part 209 and a driving control part 210.

The controller part 201 is mutually communicable with the host computer 200, the discharging option control part 202 and the engine control part 203. The controller part 201 receives image information and a print command from the host computer 200, analyzes the received image information and converts the image information into bit data. The controller part 201 transmits, for every transferring material, a scheduled print command, a print start command and video signals to the engine control part 203 via the vide interface part 210. Further, at this time, the controller part 201 also transmits, based on an instruction given from the host computer 200, an instruction signal relating to the use of the discharging control option 26 to the discharging option control part 202.

The controller part 201 sends the scheduled print command to the engine control part 203 in accordance with the print command given from the host computer 200, and sends the print start command to the engine control part 203 at a timing when a printable status occurs.

The engine control part 203 performs print executing preparations in the order indicated by the scheduled print command sent from the controller part 201, and waits for the print start command to be issued from the controller part 201. The engine control part 203, upon receiving the print instruction signal, outputs a /TOP signal serving as a reference timing for outputting the video signals to the controller part 201, and starts a print operation as the scheduled print command instructs.

FIG. 8 is a flowchart showing a flow of the print operation of the engine control part 203 shown in FIG. 7.

The engine control part 203, when receiving the scheduled print command, waits for receiving the print start command (step S801), and executes pre-processing (which will hereinafter be termed an initial rotation sequence) for conducting the print operation (step S802). The engine control part 203, after an end of the initial rotation sequence, outputs the /TOP signal and starts the print operation (sequence) according to the scheduled print command of the first sheet (step S803).

The engine control part 203, if a next scheduled print command is not received (step S805) till a next print operation start timing (which will hereinafter be referred to as a normal print start timing) for maintaining a throughput (step S804), executes post-processing (which will hereinafter be termed a post-rotation sequence) of the print operation (step S809), and thereafter finishes the present print operation.

While on the other hand, if the next scheduled print command is received (step S805) till the next normal print start timing (step S804), and if a print start command for the scheduled print command is received (step S806), the engine control part 203 starts the print operation of the second sheet subsequent to the first sheet (step S803).

Further, if the scheduled print command is received (step S805) till the next normal print start timing (step S804), and if the print start command is not received (step S806), the engine control part 203 executes the post-rotation sequence (step S807) and comes to a print start command waiting status (step S808). Then, the engine control part 203, after waiting for receiving the print start command, starts the initial rotation sequence (step S802).

Next, a duplex printing operation in a case where the discharging option 26 is designated at a discharging port in the printer P shown in FIG. 6, will be explained referring to FIGS. 9 and 10.

Herein, the duplex printing operations of three sheets (6-page printing) to the discharging option 26 from a transferring material cassette 1 will be described.

FIG. 9 is a diagram of a communication sequence of the controller part 201 in the case of effecting the duplex printing in the printer P shown in FIG. 6.

The controller part 201 alternately transmits, to the engine control part 203, the scheduled print command from the transferring material cassette 1 (referred to as "C" in FIGS. 1, 2, 9, 11 and 12) to the duplex unit (referred to as "U" in FIGS. 1, 2, 9, 11 and 12) and the scheduled print command from the duplex unit to the discharging option (referred to as "O" in FIGS. 1, 2, 9, 11 and 12) 26 (S911, S912, S913, S914, S915, S916). Then, the controller part 201 transmits to the discharging option control part 202, a scheduled discharging command 1 in S901, a scheduled discharging command 2 in S903 and a scheduled discharging command 3 in S905, respectively. The controller part 201, after transmitting the scheduled discharging command 1 in S901, the scheduled discharging command 2 in S903 and the scheduled discharging command 3 in S905, acquires from the discharging option control part 202 a discharging interval at which a next transferring material becomes receivable since a transferring material with the discharging option 26 scheduled has been received (S902, S904). Thereafter, the controller part 201 sends the print start command of the first sheet to the engine control part 203 (S917).

The engine control part 203, upon receiving the print start command 1 from the controller part 201 (S917), executes the initial rotation sequence, then starts the print operation by outputting a /TOP signal 1 to the controller part 201 (S918), and conveys the transferring material to the duplex unit from the transferring material cassette 1.

The controller part 201 outputs the video signals in synchronization with the /TOP signal 1 received from the engine control part 203, and outputs the print start command 2 for the next scheduled print command 2 in S912 (S919).

The engine control part 203, upon receiving the print start command 2 from the controller part 201 (S919), transmits a /TOP signal 2 to the controller part 201 at the normal print start timing of the second sheet (S920). Then, the engine control part 203 continues the print operation of the scheduled print command 2 in S912 subsequent to the first sheet, and conveys the transferring material to the discharging option 26 from the duplex unit.

Hereafter, similarly, the engine control part 203, when receiving the print start command till the normal print start timing, continues the print operation in the order designated by the print schedule.

Note that the case of receiving the print start command after having already made the print schedule is herein explained, however, the controller part 201 is capable of continuing the consecutive printing by transmitting the scheduled print command and the print start command of the next page till the normal print start timing during the consecutive printing.

FIG. 10 is a timing chart showing an operation timing of the engine control part 203 in the case of performing the duplex printing in the printer P illustrated in FIG. 6.

The engine control part 203, when receiving from the controller part 201 the print start command 1 for the scheduled print command of the first sheet (S1011), starts the initial rotation sequence. During this initial rotation sequence, the engine control part 203, after an end of the initial rotation sequence, start the print operation of the first sheet by outputting the /TOP signal 1 (S1021), and conveys the transferring material to the duplex unit from the transferring material cassette 1.

The engine control part 203, in the case of receiving the print start command 2 (S1012) till the normal print start timing of the second sheet (S1002) after transmitting the /TOP signal 1 of the first sheet (S1021), starts the print operation of the second sheet subsequent to the first sheet by outputting the /TOP signal 2 (S1022) at the normal print start timing of the second sheet (S1002), and conveys the transferring material to the discharging option 206 from the duplex unit.

Thereafter, the engine control part 203, in the case of receiving the scheduled print command and the print start command of the next page till the normal print start timing, continues the consecutive printing by outputting the /TOP signal.

While on the other hand, in the case of receiving neither the scheduled print command nor the print start command of the next page till the normal print start timing (during a period of S1006–S1007), the engine control part 203 starts the post-rotation sequence, and finishes the print operation.

Next, a print operation in the case of stapling the transferring materials discharged to the discharging option 26 when conducting the duplex printing to the discharging option 26 from the transferring material cassette 1 in the printer P illustrated in FIG. 6, will be described with reference to FIGS. 11 and 12.

Given herein is an explanation of an operation in the case of stapling at a point of time when the second sheet is discharged to the discharging option 26 on the occasion of the duplex printing of three sheets (6-page printing) to the discharging option 26 from the transferring material cassette 1 in the same way as FIGS. 9 and 10 shows.

FIG. 11 is a diagram of a communication sequence of the controller part 201 in the case of stapling during the duplex printing in the printer P shown in FIG. 6.

The controller part 201 alternately transmits, to the engine control part 203, the scheduled print command from the transferring material cassette 1 to the duplex unit and the scheduled print command from the duplex unit to the discharging option 26 (S1111, S1112, S1113, S1114, S1115, S1116). Then, the controller part 201 transmits to the discharging option control part 202 a scheduled discharging command 1 in S1101, a scheduled discharging command 2 in S1103 and a scheduled discharging command 3 in S1105, respectively.

The controller part 201, when transmitting the scheduled discharging command 1 in S1101, the scheduled discharging command 2 in S1103 and the scheduled discharging command 3 in S1105, acquires from the discharging option control part 202 a discharging interval at which a next transferring material becomes receivable since a transferring material with the discharging option scheduled has been received (S1102, S1104, S1106).

Thereafter, the controller part 201 transmits the print start command 1 to the engine control part 203 (S1117), whereby the engine control part 203 starts the print operation by outputting the /TOP signal 1 of the first sheet (S1112), and conveys the transferring material to the duplex unit from the transferring material cassette 1.

As for the pages from the second page onwards, the controller part 201 transmits the scheduled print command and the print start command till the normal print start command, whereby the engine control part 203 can continue the consecutive printing by outputting the /TOP signal at the normal print timing.

Concerning the third sheet, i.e., "a transferring material corresponding to a scheduled print 6 in S116", discharged to the discharging option 26, however, the print of the third sheet can not be started during a period, i.e., "a period of a discharging interval 2 (A)", for which the discharging option 26 can receive the third sheet with an end of stapling of the second sheet, i.e., "a transferring material corresponding to a scheduled print 4 in S1114".

Accordingly, the controller part 201 is required to transmit the print start command of the third sheet of "transferring material corresponding to the scheduled print 6 in S1116" so that a print interval between the second sheet of "transferring material corresponding to the scheduled print 4 in S1114" and the third sheet of "transferring material corresponding to the scheduled print 6 in S1116" is longer than a discharging interval A in S1104 that has been acquired when making a schedule of the second sheet of "transferring material corresponding to the scheduled print 4 in S1114 which has been discharged to the discharging option 26 last time" with respect to the discharging option 26.

At this time, if the controller part 201 transmits the print start command till the normal print start timing, the engine control part 203 starts the print operation at the normal interval (which continues the consecutive printing without expanding an interval between the transferring materials), and hence it follows that the second and third sheets of transferring materials collide with each other within the discharging option 26.

FIG. 12 is a timing chart showing an operation timing of the engine control part 203 in the case of effecting stapling during the duplex printing in the printer P shown in FIG. 6.

The controller part 201 transmits to the engine control part 203 the print start command of the third sheet of "transferring material corresponding to the scheduled print 6 in S1216" after an elapse of the sheet discharging interval A in S1230 since the print start timing (S1204) of the second sheet of "transferring material corresponding to the scheduled print 4 in S1214".

If a timing (S1207) at which the discharging interval A in S1230 elapses since the print start timing of the second sheet of "transferring material corresponding to the scheduled print 4 in S1214" is posterior to the normal print timing (S1206) of the third sheet of "transferring material corresponding to the scheduled print 6 in S1216", the engine control part 203 temporarily executes the post-rotation sequence at a point of time of S1206.

Thereafter, the engine control part 203 starts the initial rotation sequence after waiting for receiving the print start command in S1216, of the third sheet of "transferring material corresponding to the scheduled print 6 in S1216".

Further, Japanese Patent Application Laid-Open Publication No. 2001-88370 discloses a conventional technology related to the image forming apparatus pertaining to the scheduled print.

In the sequence in the conventional image forming apparatus described above, however, the post-rotation sequence is executed before starting the print operation corresponding to the scheduled print 6. Therefore, the print operation corresponding to the scheduled print 6 in S1216 can be originally started after the sheet discharging interval A (just when in S1207) since the print start timing (S1204) of the scheduled print 4, and nevertheless a downtime elongates as much as a period of the point of time in S1207 through the end (S1208) of the initial rotation sequence.

It is required for eliminating the downtime to control so as not to execute the post-rotation sequence till the discharging interval A (till the point of time in S1207) since the print start timing (S1204) of the scheduled print 4, and this control was hard to perform.

SUMMARY OF THE INVENTION

It is an object of the present invention, which was devised to obviate the problems inherent in the prior arts described above, to provide an image forming apparatus capable of eliminating a futile downtime without any interruption of consecutive printing by virtue of processing of an discharging option such as changeover of discharging bins, stapling, bookbinding, etc. even in a case where an interval between recording materials is expanded wider than normal.

To accomplish the above object, an image forming apparatus according the present invention comprises an engine control part for controlling an engine, a controller part connected in a communicable manner to the engine control part, print scheduling means for setting a schedule of a print operation for every material for recording from the controller part to the engine control part, a recording material discharging device control part connected in the communicable manner to the controller part and serving to control a recording material discharging device for discharging the recording material to outside, recording material discharging schedule operation means for setting a schedule of a recording material discharging operation from the controller part to the recording material discharging device control part, recording material discharging interval notifying means for notifying the controller part of a recording material discharging interval till the recording material discharging device becomes receivable of the recording material next time when the recording material discharging schedule operation means sets the schedule of the recording material discharging operation for the recording material discharging device control part, and recording material discharging interval designation means for notifying the engine control part of information about the recording material discharging interval of which the recording material discharging interval notifying means has notified, from the controller part, wherein the engine control part sets the recording material discharging interval designated by the recording material discharging interval designation means as a recording material discharging interval from the recording material discharged by the recording material discharging device last time, and determines a print operation start timing in consideration of the designated recording material discharging interval and, in the case of performing the print operation for a different sheet discharging port after discharging the recording material to the recording material discharging device last time, a time expended for this print operation.

According to the present invention, it is possible to eliminate the futile downtime without any interruption of the consecutive printing by virtue of processing of the discharging option such as the changeover of discharging bins, stapling, bookbinding, etc. even in the case where the interval between recording materials is expanded wider than normal.

DESCRIPTION OF THE PREFERRED EMBODIMENTS

Embodiments of the present invention will hereinafter be described with reference to FIGS. 1 through 5A and 5B.

First Embodiment

To begin with, a first embodiment of the present invention will be discussed with reference to FIGS. 1 through 3.

Figure 6:
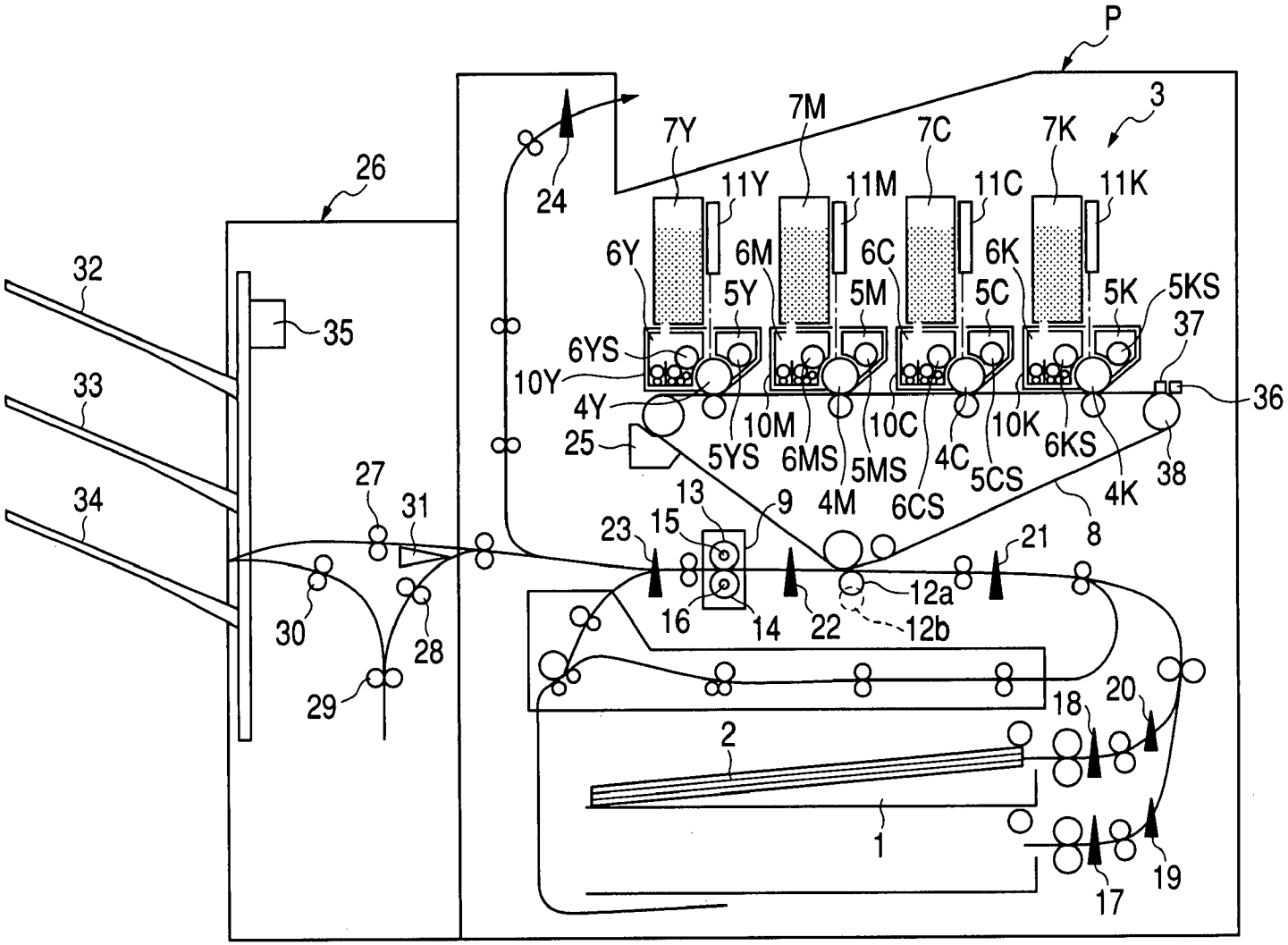
FIG. 6 is a schematic side sectional view showing a whole configuration of a printer as a conventional image forming apparatus.
Figure 7:
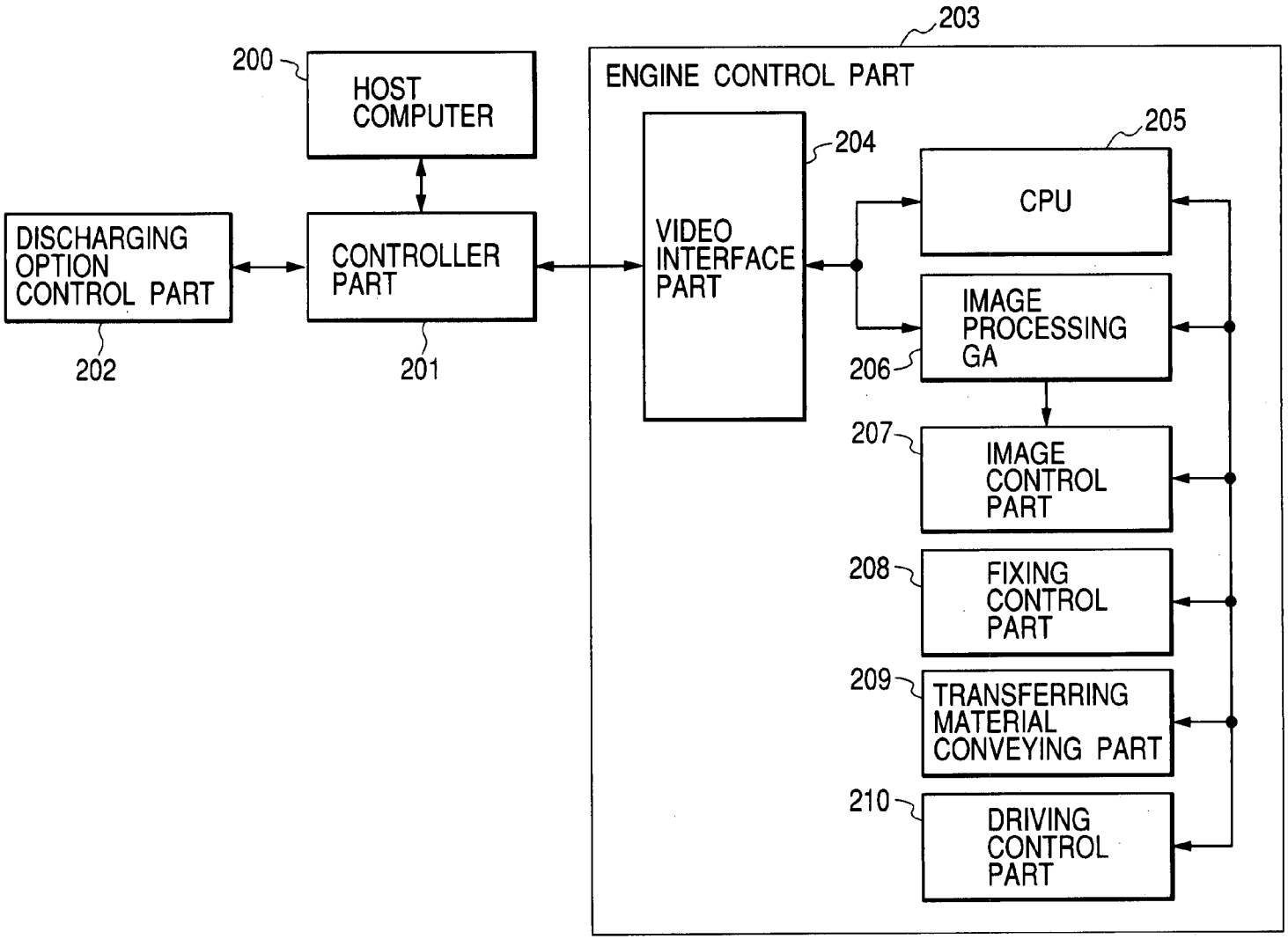
FIG. 7 is a block diagram showing a system architecture of the printer as the conventional image forming apparatus.
Figure 8:
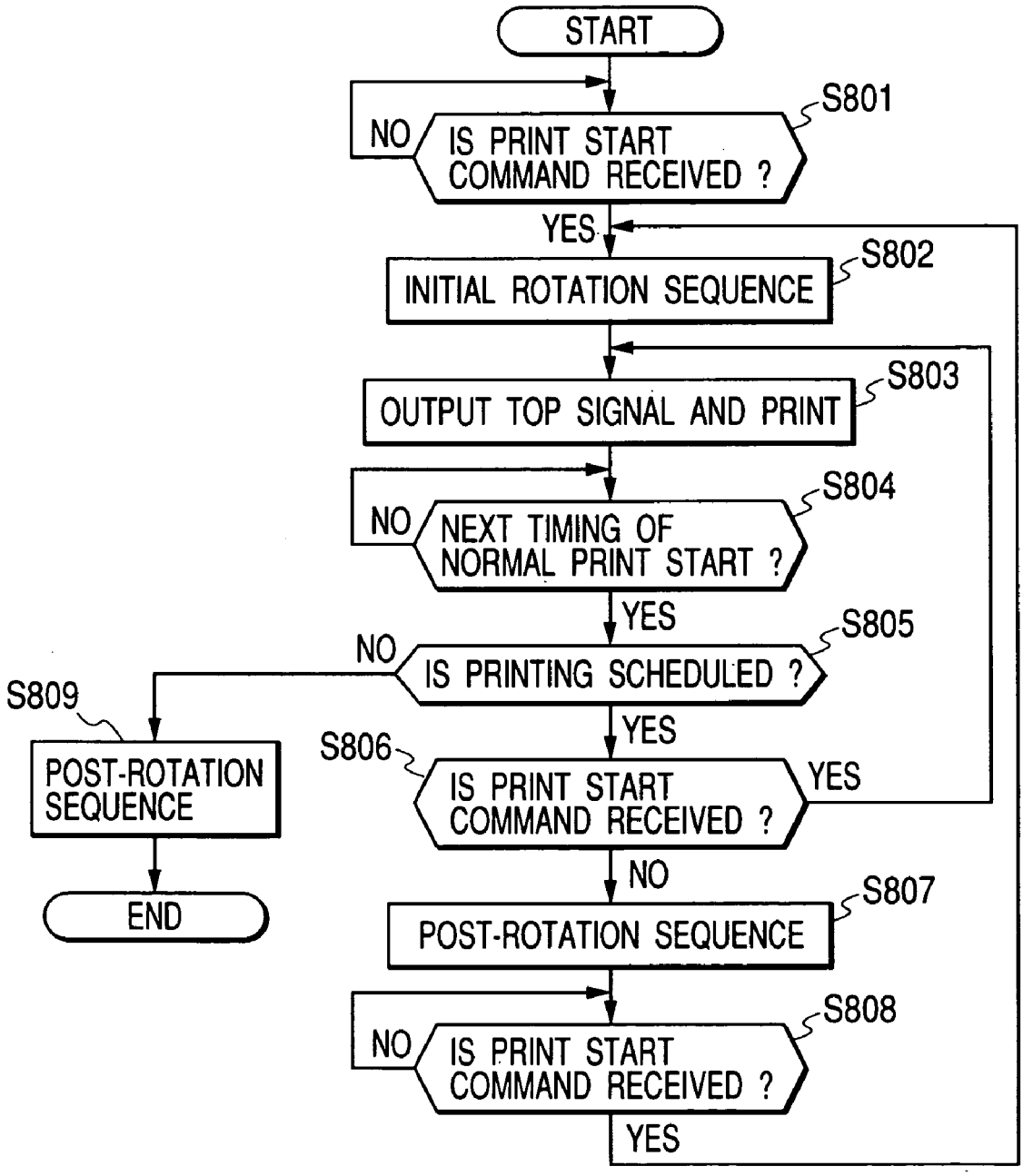
FIG. 8 is a flowchart showing a flow of operation of an engine control part in the printer as the conventional image forming apparatus.
Figure 9:
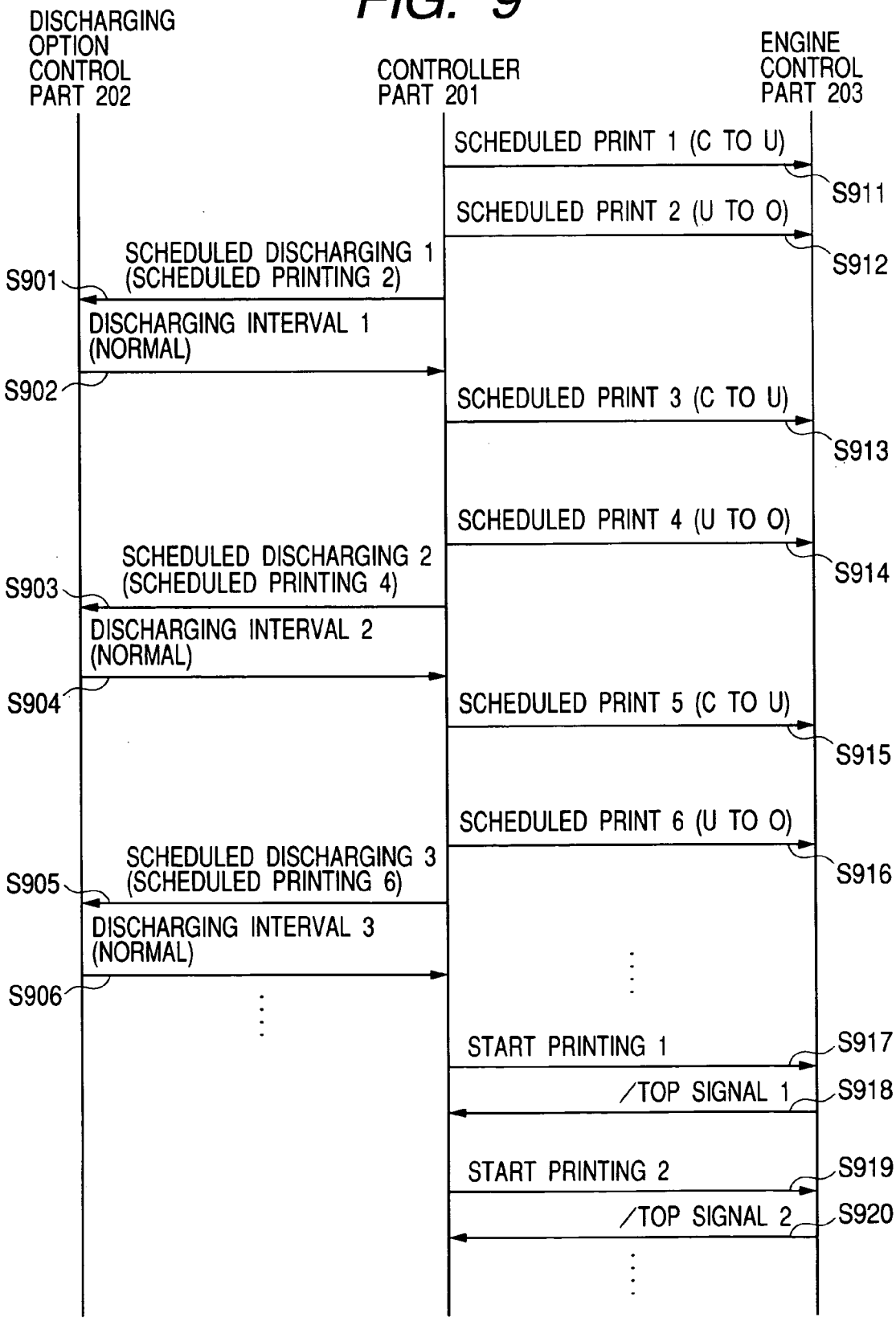
FIG. 9 is a diagram of a communication sequence of a controller part in the case of performing duplex printing in the printer as the conventional image forming apparatus.
Figure 10:
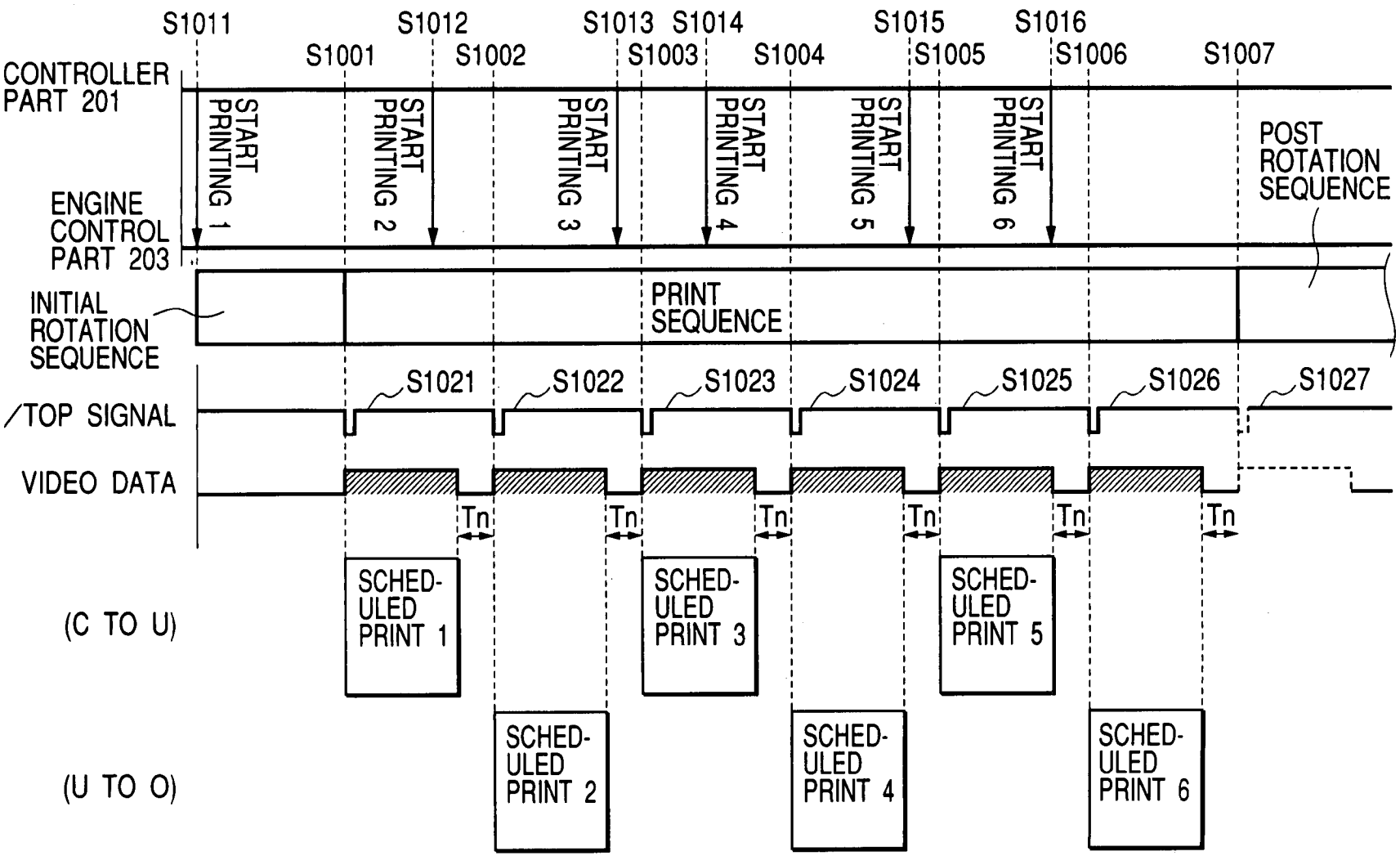
FIG. 10 is a timing chart showing an operation timing of the engine control in the case of performing the duplex printing in the printer as the conventional image forming apparatus.
Figure 11:
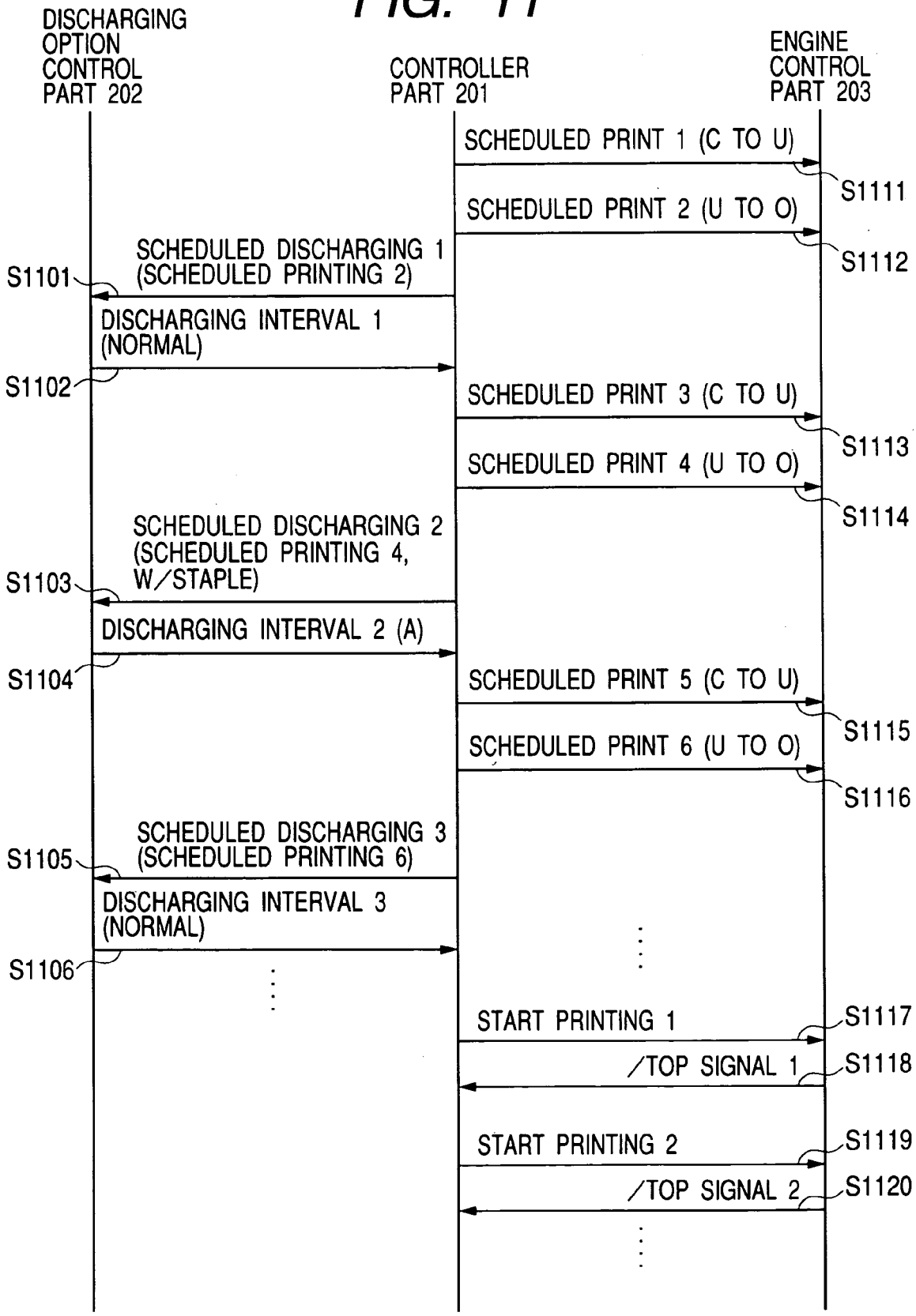
FIG. 11 is a diagram of a communication sequence of the controller part in the case of stapling in the printer as the conventional image forming apparatus.
Figure 12:
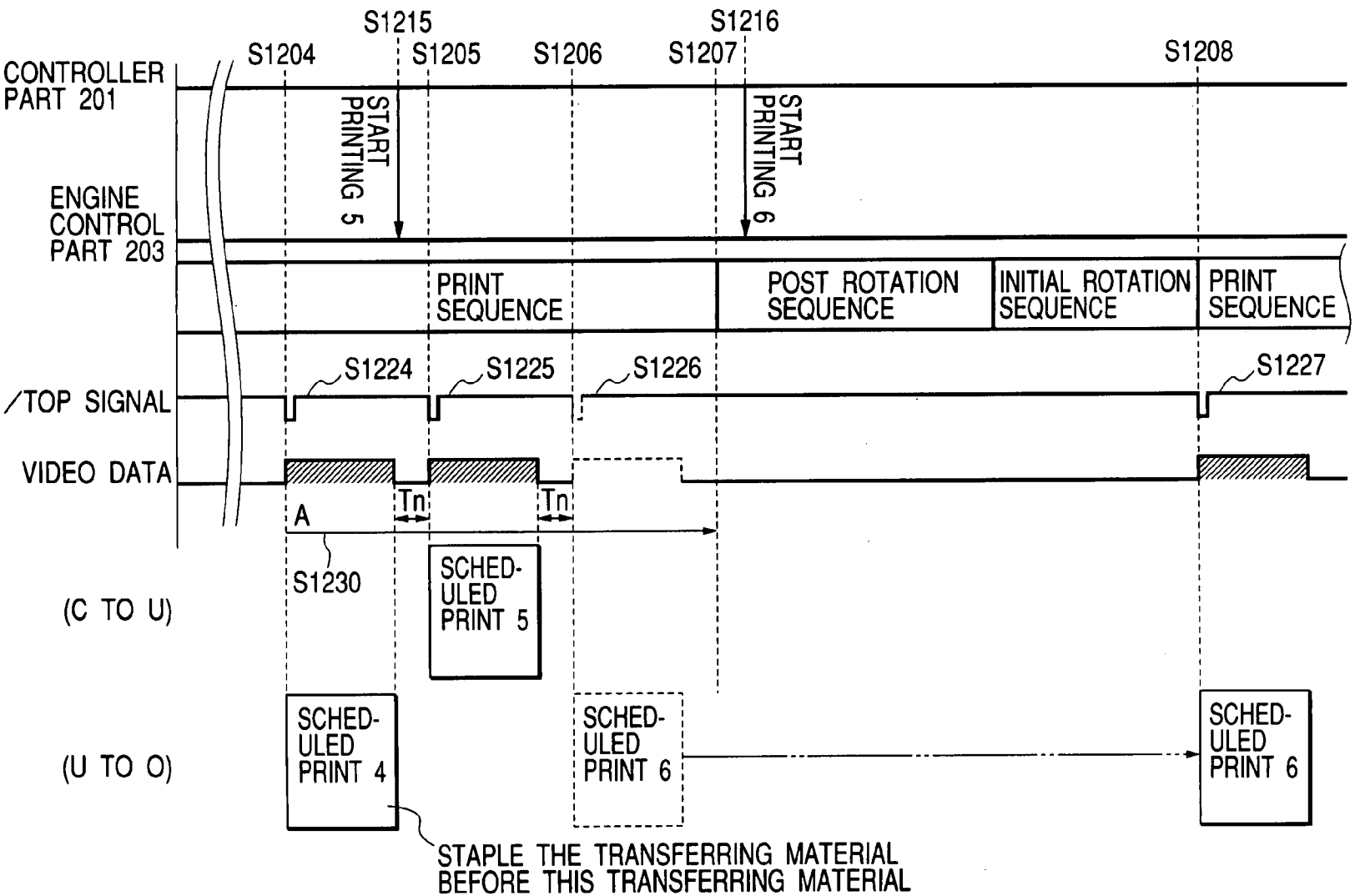
FIG. 12 is a timing chart showing an operation timing of the engine control in the case of stapling in the printer as the conventional image forming apparatus.

Note that a basic configuration of an image forming apparatus in the first embodiment is the same as the configuration shown in FIGS. 6 and 7 in the prior art described above, and hence FIGS. 6 and 7 are diverted to the discussion that will proceed as the necessity may arise.

A scheme in the first embodiment is that a controller part 201 transmits to an engine control part 203 a command (which will hereinafter be described as a discharging interval designation command) for designating a discharging interval as a print interval of which a discharging option control part 202 has notified, whereby a futile downtime is eliminated by continuing a print operation without any interruption of consecutive printing (without executing a post-rotation sequence) by virtue of processing of an discharging option 26 such as changeover of discharging bins, stapling, bookbinding, etc. even in a case where an interval between transferring materials (materials for recording) is expanded wider than normal.

To be specific, in the case of transmitting to the engine control part 203 a scheduled print command that designates the discharging option 26 at a discharging port, the controller part 201 transmits, before transmitting the scheduled print command, to the engine control part 203 the discharging interval designation command added with a piece of discharging interval information (which is a time till a next transferring material becomes acceptable since the discharging option 26 has processed a scheduled transferring material) of which the discharging option 26 notified last time.

The engine control part 203, upon receiving the scheduled print command designating the discharging option 26 at the discharging port, determines a print operation start timing, wherein the discharging interval designated by the discharging interval designation command received before receiving the scheduled print command, is set as a discharging interval from the transferring material discharged to the discharging option 26 last time.

The discussion will hereinafter be made by exemplifying a case in which first and second sheets are stapled when effecting duplex printing of three sheets (6-page printing) from the same transferring material cassette 1 to the discharging option 26.

Figure 1:
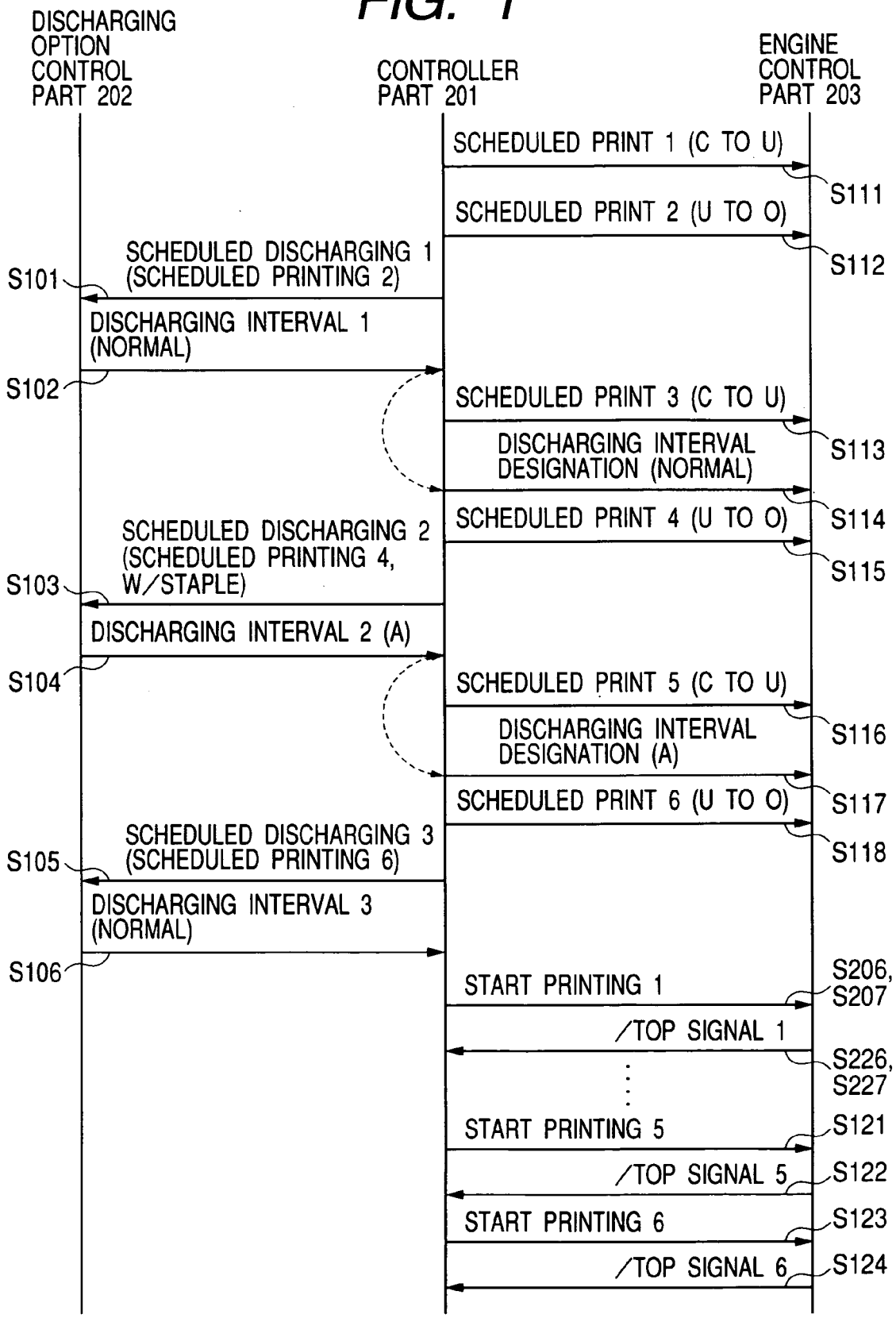
FIG. 1 is a diagram of a communication sequence of a controller part in a printer defined as an image forming apparatus in a first embodiment of the present invention.

FIG. 1 is a diagram of a communication sequence of the controller part 201 in a printer P defined as an image forming apparatus in the first embodiment.

The controller part 201, after transmitting to the engine control part 203 a scheduled print command 1 from the transferring material cassette 1 to a duplex unit, a scheduled print command 2 from the duplex unit to the discharging option 26 (S111, S112), transmits a scheduled sheet discharging command 1 that designates normal discharging to the discharging option control part 202 (S101).

The controller part 201 acquires a discharging interval from the discharging option control part 202 as a return status of the scheduled sheet discharging command 1 in S101 (S102).

The controller part 201 transmits a scheduled print command 3 from the transferring material cassette 1 to the duplex unit subsequently to the scheduled print command 1 in S111 and the scheduled print command 2 in S112 (S113).

Further, the controller part 201 transmits to the engine control part 203 a discharging interval designation command in S114, added with the information about the discharging interval 1 in S102 that has been acquired from the discharging option 26 last time, and a scheduled discharging command 4 from the next duplex unit to the discharging option 26 (S114).

The controller part 201 executes a discharging schedule that designates a stapling operation with respect to the discharging option control part 202 in order to staple two sheets of transferring materials designated by the scheduled discharge command 4 in S115 from the scheduled print command 1 in S111 (S103).

The sheet discharging option control part 202 receives the transferring material corresponding to the scheduled print command 4 in S115 within the discharging option 26 as a return status of the scheduled sheet discharging 2 in S103, and performs stapling. Thereafter, the sheet discharging option control part 202 notifies the controller part 201 of a time A till a next transferring material (corresponding to the scheduled print command 6 in S118) becomes receivable (S104).

Thereafter, the controller part 201 transmits to the engine control part 203 a scheduled print command 5 from the transferring material cassette 1 to the duplex unit in S116, a discharging interval designation command (A) to which the information on the discharging interval 2 in S104 has been added in S117, and a scheduled print command 6 to the discharging option 26 from the duplex unit in S118, respectively (S118).

Figure 2:
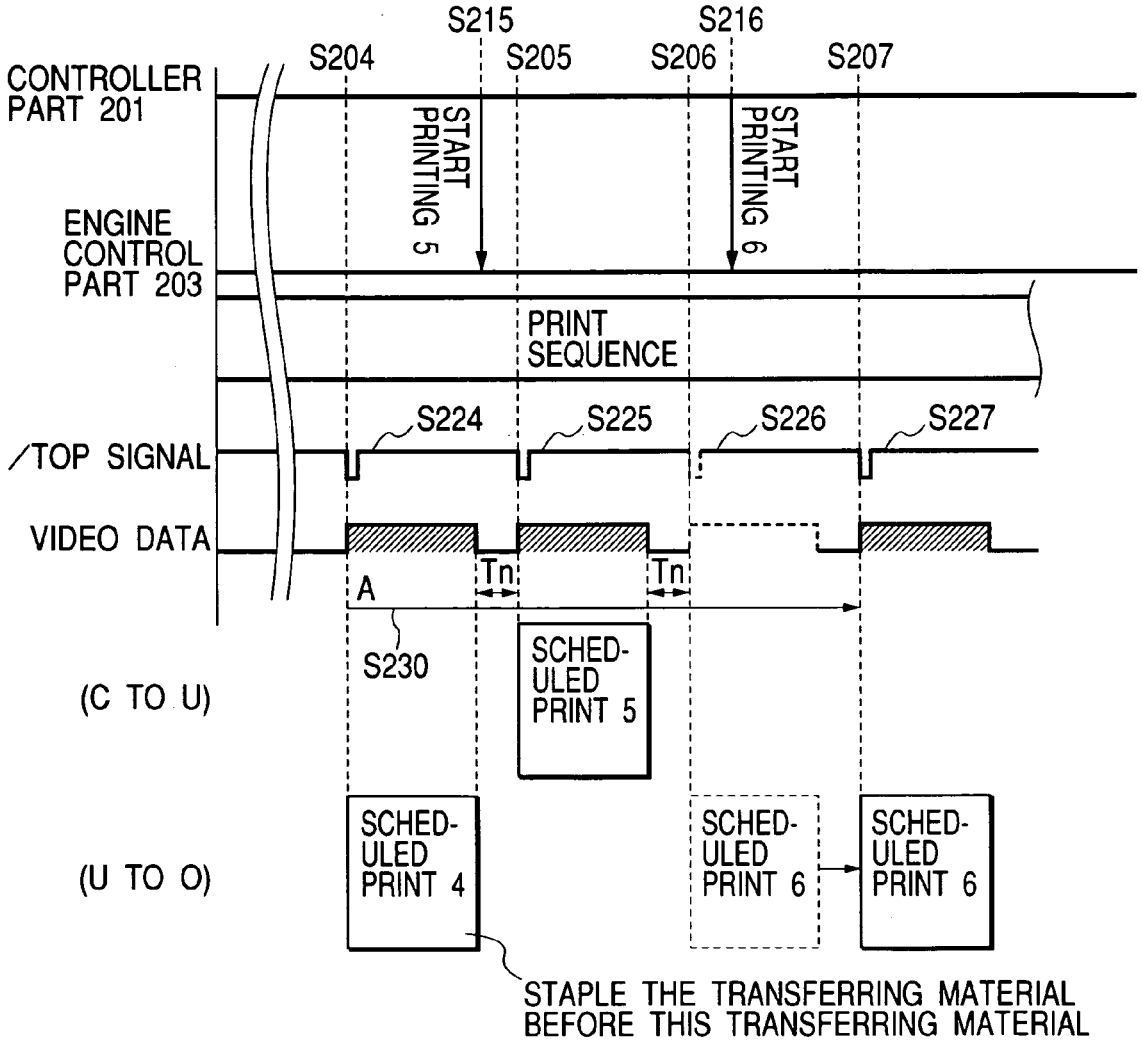
FIG. 2 is a timing chart showing an operation timing of an engine control part in the printer as the image forming apparatus in accordance with the first embodiment of the present invention.

FIG. 2 is a timing chart showing an operation timing of the engine control part 203 in the image forming apparatus in accordance with the first embodiment.

The engine control part 203 compares the discharging interval 2 (S204, S230) received before receiving the scheduled print command 6 (S118) at a normal print start timing (S206) of the scheduled print command (S118) with a time since a print start timing of the transferring material discharged to the discharging option 26 last time.

If the time (which a period of S204 through S206) since the print start timing of the transferring material discharged to the discharging option 26 last time is longer than the discharging interval (S230), the engine control part 203 starts the print operation by outputting a /TOP signal at the normal print start timing (S206) of the scheduled print command 6 (S218).

If the time (the period of S204 through S206) since the print start timing of the transferring material discharged to the discharging option 26 last time does not reach the discharging interval (S230), the engine control part 203 waits till the time since the print start timing of the transferring material discharged to the discharging option 26 last time reaches the discharging interval (S230), and then starts the print operation.

In the case of FIG. 2, the time (the period of S204 through S206) since the print start timing of the transferring material discharged to the discharging option 26 last time does not reach the discharging interval (S230), and hence the engine control part 203 waits till there comes the timing (S207) of an elapse of the discharging interval (S230) without outputting the /TOP signal (S226), and then outputs the /TOP signal (S227).

Figure 3:
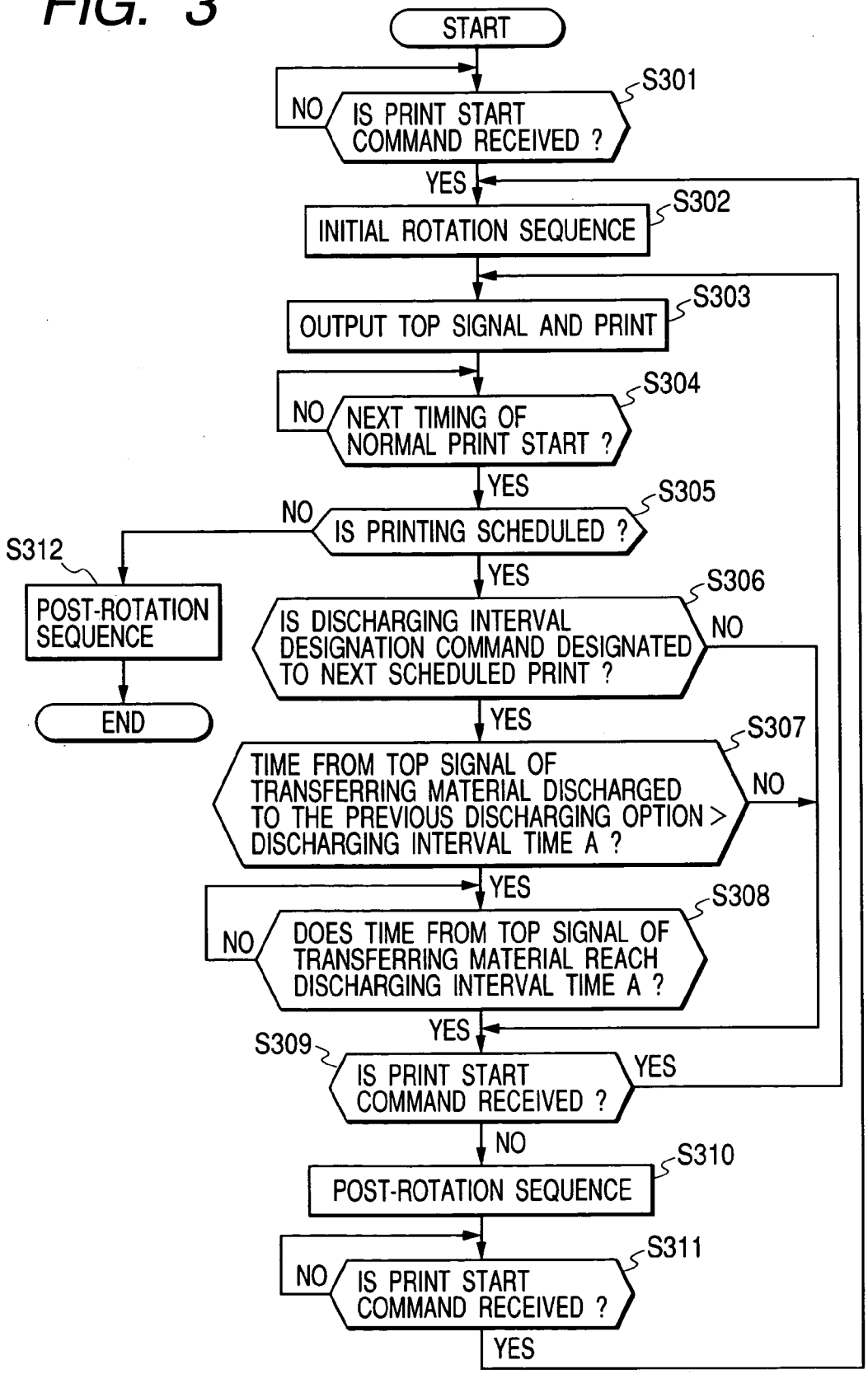
FIG. 3 is a flowchart showing a flow of operation of the engine control part in the printer as the image forming apparatus in accordance with the first embodiment of the present invention.

FIG. 3 is a flowchart showing a flow of operation of the engine control part 203 in the image forming apparatus in the first embodiment.

The engine control part 203, upon receiving the scheduled print command, waits for a receipt of the print start command (step S301), and executes an initial rotation sequence (step S302). After an end of the initial rotation sequence, the engine control part 203 outputs the /TOP signal and starts the print operation in accordance with a print operation condition designated by the scheduled print command of the first sheet (step S303).

The following processing is executed from the second page onwards.

The engine control part 203, if the next scheduled print command is not received till the normal print start timing (step S304) (S305), executes the post-processing (the post-rotation sequence) of the print operation (step S312), and thereafter finishes the present print operation.

Further, if the next scheduled print command is received till the normal print start timing (S305), the engine control part 203 checks whether the discharging interval designation command is received or not (step S306). Then, if the discharging interval designation command is not received, the engine control part 203 checks whether the print start command is received or not (step S309). If the print start command is received, subsequently the consecutive print continues (step S303). Whereas if the print start command is not received (step S309), the engine control part 203 executes the post-rotation sequence (step S310) and comes to a print start command waiting status (step S311). The engine control part 203, upon receiving the print start command in the print start command waiting status (step S311), starts the initial rotation sequence (step S302), and resumes the print operation.

While on the other hand, in the case of receiving the discharging interval designation command (step S306), the engine control part 203 compares the time since the print start timing of the transferring material discharged to the discharging option 26 last time with the discharging interval time A designated by the discharging interval designation command (step S307). Then, if the time since the print start timing of the transferring material discharged to the discharging option 26 last time is longer than the discharging interval time A, the engine control part 203 checks whether or not the time since the print start timing of the transferring material discharged to the discharging option 26 last time reaches the discharging interval time A (step S308). Then, if the time since the print start timing of the transferring material discharged to the discharging option 26 last time reaches the discharging interval time A, the engine control part 203 checks whether the print start command is received or not (step S309). If received, the engine control part 203 outputs the /TOP signal and continues the print operation (step S303).

Further, whereas if the time since the print start timing of the transferring material discharged to the discharging option 26 last time does not reach the discharging interval time A, the engine control part 203 waits till the time since the print start timing of the transferring material discharged to the discharging option 26 last time reaches the discharging interval time A, and checks whether the print start command is received or not (step S309). If received, the engine control part 203 outputs the /TOP signal and continues the print operation (step S303).

As discussed above, according to the image forming apparatus in the first embodiment, the futile downtime can be avoided by continuing the print operation without any interruption of the consecutive printing (without executing the post-rotation sequence) by virtue of the processing of the discharging option 26 such as changeover of the discharging bins, stapling, bookbinding, etc. even in the case where the interval between transferring materials is expanded wider than normal.

Note that the first embodiment discussed above can be changed in a variety of forms based on the gist of the present invention, and these changes are not excluded from the scope of the invention.

Second Embodiment

Next, a second embodiment of the present invention will be explained on the basis of FIG. 4.

Note that the basic configuration of the image forming apparatus in the second embodiment is the same as the configuration shown in FIGS. 6 and 7 in the prior art described above, and hence FIGS. 6 and 7 are diverted to the discussion that will proceed as the necessity may arise.

A scheme in the second embodiment is that the discharging option 26 and the discharging option control part 203 in the configuration in FIG. 2 are replaced by a supplying option and a supplying option control part which serve to supply the transferring material, the controller part 201 transmits to the engine control part 203 a command (which will hereinafter be described as a supplying interval designation command) for designating a supplying interval till the next transferring material can be supplied from the supplying option control part, and the consecutive printing continues without interrupting the consecutive printing even in the case of having a necessity for expanding the interval between the transferring materials wider than normal due to convenience in terms of a structure of the supplying option as supplying port switchover, etc occurs during the supply of the transferring material in the multi-staged supplying option.

Specifically, the controller part 201, in the case of transmitting to the engine control part 203 a scheduled print command that designates a supplying option at a supplying port of the transferring material, previously makes a supplying schedule for the supplying option before sending the scheduled print command, and acquires pieces of supplying interval information (about the transferring material supplied from the supplying option last time and about a time till the scheduled transferring material can be supplied) as a return status thereof.

Thereafter, the controller part 201 sends to the engine control part 203 a supplying interval designation command added with the supplying interval information and a scheduled print command.

The engine control part 203, upon receiving the scheduled print command that designates the supplying option at the supplying port, sets the supplying interval designated by the supplying interval designation command received before receiving the scheduled print command as a supplying interval from the transferring material supplied to the supplying option last time. Then, if the designated supplying interval is shorter than a time since a start of printing the transferring material supplied form the supplying option last time, the engine control part 203 starts the print operation at the normal print start timing, and, if the designated supplying interval is longer than the time since the start of printing the transferring material supplied form the supplying option last time, waits till an elapse of the supplying interval and then starts the print operation.

Figure 4:
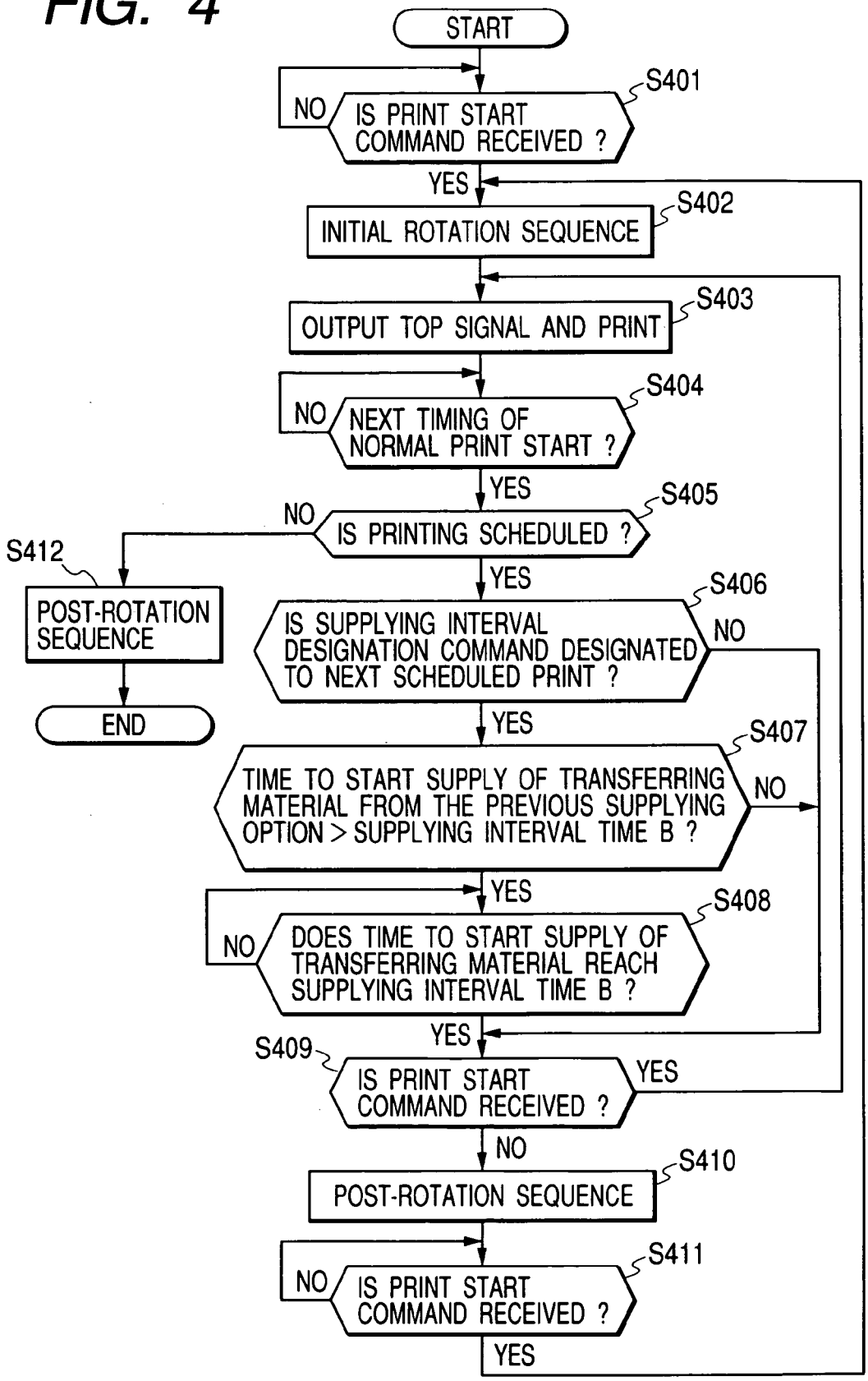
FIG. 4 is a flowchart showing a flow of operation of the engine control part in the printer as the image forming apparatus in accordance with a second embodiment of the present invention.

FIG. 4 is a flowchart showing a flow of operation of the engine control part 203 in the image forming apparatus in the second embodiment.

The engine control part 203, upon receiving the scheduled print command, waits for a receipt of the print start command (step S401), and executes the initial rotation sequence (step S402). After an end of the initial rotation sequence, the engine control part 203 outputs the /TOP signal and starts the print operation in accordance with a print operation condition designated by the scheduled print command of the first sheet (step S403).

The following processing is executed from the second page onwards.

The engine control part 203, if the next scheduled print command is not received till the normal print start timing (step S404) (S405), executes the post-rotation sequence (step S412), and thereafter finishes the present print operation.

Further, if the next scheduled print command is received till the normal print start timing (S404) (step S405), the engine control part 203 checks whether the supplying interval designation command is received or not (step S406). Then, if the supplying interval designation command is not received, the engine control part 203 checks whether the print start command is received or not (step S409). If the print start command is received, subsequently the consecutive print continues (step S402). Whereas if the print start command is not received (step S409), the engine control part 203 executes the post-rotation sequence (step S410) and comes to a print start command waiting status (step S411). The engine control part 203, upon receiving the print start command in the print start command waiting status (step S411), starts the initial rotation sequence (step S402), and resumes the print operation.

While on the other hand, in the case of receiving the supplying interval designation command (step S406), the engine control part 203 compares the time since the print start timing of the transferring material supplied from the supplying option last time with a supplying interval time B designated by the supplying interval designation command (step S407). Then, if the time since the print start timing of the transferring material supplied from the supplying option last time is longer than the supplying interval time B, the engine control part 203 checks whether or not the time since the print start timing of the transferring material supplied from the supplying option last time reaches the supplying interval time B (step S408).

Then, if the time since the print start timing of the transferring material supplied from the supplying option last time does not reach the supplying interval time B, the engine control part 203 waits till the time since the print start timing of the transferring material supplied from the supplying option last time reaches the supplying interval time B, and, thereafter, in the case of receiving the print start command (step S409), continues the print operation by outputting the /TOP signal (step S403).

As discussed above, according to the image forming apparatus in the second embodiment, the futile downtime can be avoided by continuing the print operation without any interruption of the consecutive printing (without executing the post-rotation sequence) even in the case where the interval between transferring materials is expanded wider than normal due to convenience in terms of the structure of the supplying option as the supplying port switchover, etc occurs during the supply of the transferring material in the multi-staged supplying option.

Note that the second embodiment discussed above can be changed in a variety of forms based on the gist of the present invention, and these changes are not excluded from the scope of the invention.

Third Embodiment

Next, a third embodiment of the present invention will be explained on the basis of FIG. 5.

Note that the basic configuration of the image forming apparatus in the third embodiment is the same as the configuration shown in FIGS. 6 and 7 in the prior art described above, and therefore FIGS. 6 and 7 are diverted to the discussion that will proceed as the necessity may arise.

A scheme in the third embodiment is that the print operation can continue even in a case where the supplying port switchover in the multi-staged supplying option and the processing of the discharging option such as the changeover of discharging bins, stapling, bookbinding, etc. occur for the same transferring material (the material for recording).

To be specific, the controller part 201, in the case of transmitting, to the engine control part 203, a scheduled print command that designates the supplying option at the supplying port and the discharging option at the discharging port, previously makes a supplying schedule for the supplying option before sending the scheduled print command, and transmits to the engine control part 203 a supplying interval designation command added with pieces of supplying interval information (about the transferring material supplied from the supplying option last time and about a time till the scheduled transferring material can be supplied) as a return status thereof.

Next, the controller part 201 sends to the engine control part 203 a discharging interval designation command added with a piece of discharging interval information (about a time till the next transferring material becomes receivable since the transferring material scheduled in the discharging option has been processed) of which the discharging option has notified last time.

Thereafter, the controller part 201 transmits to the engine control part 203 the scheduled print command that designates the supplying option at the supplying port and the discharging option at the discharging port.

The engine control part 203, upon receiving the scheduled print command that designates the supplying option at the supplying port, determines a timing for starting the print operation on the basis of the supplying interval designated by the supplying interval designation command received before receiving this scheduled print command and the discharging interval designated by the discharging interval designation command.

Figure 5B:
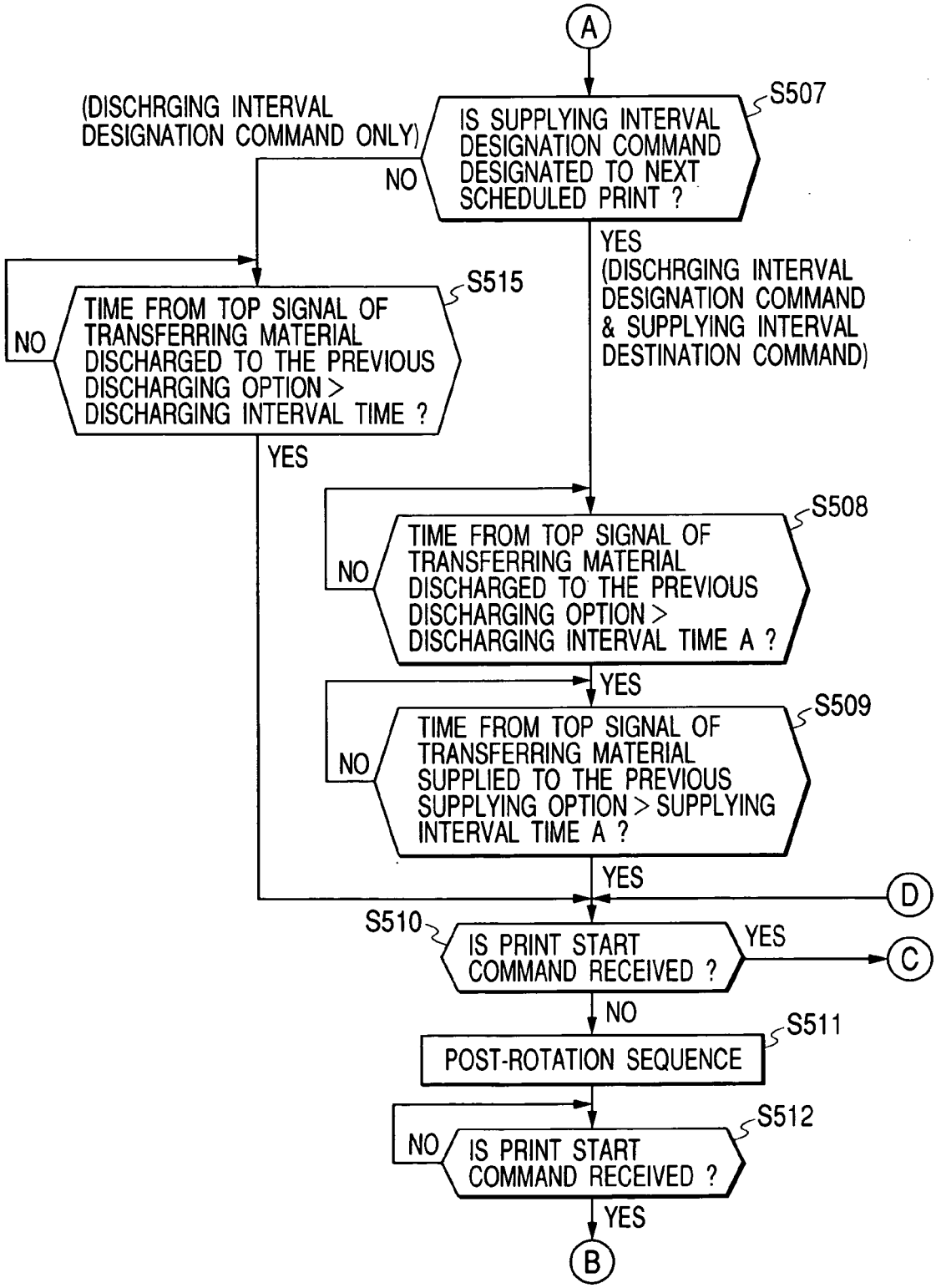
FIG. 5 is comprised of FIGS. 5A and 5B illustrating flowcharts showing a flow of operation of the engine control part in the printer as the image forming apparatus in accordance with the second embodiment of the present invention.

FIGS. 5A and 5B are flowcharts showing a flow of operation of the engine control part 203 in the image forming apparatus in the third embodiment.

The engine control part 203, upon receiving the scheduled print command, waits for a receipt of the print start command (step S501), and executes the initial rotation sequence (step S502). After an end of the initial rotation sequence, the engine control part 203 outputs the /TOP signal and starts the print operation in accordance with a print operation condition designated by the scheduled print command of the first sheet (step S503).

The following processing is executed from the second page onwards.

The engine control part 203, if the next scheduled print command is not received till the normal print start timing (step S504) (step S505), executes the post-rotation sequence (step S516), and thereafter finishes the present print operation.

Moreover, if the next scheduled print command is received till the next normal print start timing (step S504) (step S505), the engine control part 203 checks whether the discharging interval designation command is received or not (step S506). If the discharging interval designation command is not received (step S506), the engine control part 203 checks whether or not the supplying interval designation command is designated for a schedule for printing next time (step S513).

If the supplying interval designation command is not received for the schedule for printing next time, the engine control part 203 checks whether the print start command is received or not (step S510). In the case of receiving the print start command, the engine control part 203 starts the print operation in accordance with a print operation condition designated by the scheduled print command of the second sheet (step S503).

Whereas if the print start command is not received, the engine control part 203 executes the post-rotation sequence (step S511) and comes to a print start command waiting status (step S512). Then, the engine control part 203, in the case of receiving the print start command, executes the initial rotation sequence (step S502).

While on the other hand, in the case of receiving the discharging interval designation command for the schedule for printing next time (step S506), the engine control part 203 checks whether or not the supplying interval designation command is received for the schedule for printing next time (step S507). In the case of receiving none of the supplying interval designation command, i.e., in the case of receiving only the discharging interval designation command (step S507), the engine control part 203 checks whether or not a time since the /TOP signal of the transferring material discharged to the discharging option last time is longer than the discharging interval time (step S515). If the time since the /TOP signal of the transferring material discharged to the discharging option last time is longer than the discharging interval time (step S515), the engine control part 203 checks whether the print start command is received or not (step S510).

On the other hand, in the case of receiving the supplying interval designation command, viz., in the case of receiving both of the supplying interval designation command and the discharging interval designation command (step S507), the engine control part 203 checks whether or not the time since the /TOP signal of the transferring material discharged to the discharging option last time is longer than the discharging interval time (step S508). If the time since the /TOP signal of the transferring material discharged to the discharging option last time is longer than the discharging interval time (step S508), the engine control part 203 checks whether or not a time since the /TOP signal of the transferring material supplied from the supplying option last time is longer than a supplying interval time (step S509). If the time since the /TOP signal of the transferring material supplied from the supplying option last time is longer than the supplying interval time (step S509), the engine control part checks whether the print start command is received or not (step S510).

The engine control part 203 checks whether or not the print start command is received or not. The engine control part 203, in the case of receiving the print start command, subsequently continues the consecutive print (1206, 1213, 1210, 1203). Whereas if the print start command is not received, the engine control part 203 executes the post-rotation sequence and comes to a print start command waiting status (1210, 1211, 1202, 1009, 1010, 1011). The engine control part 203, upon receiving the print start command in the print start command waiting status, starts the initial rotation sequence, and resumes the print operation (1011, 1002).

In the case of receiving only a sheet feeding interval designation command, the engine control part 203 compares a time since the print start timing of the sheet fed to a sheet feeding option last time with a sheet feeding interval designated by a sheet feeding interval designation command (1206, 1213, 1214).

If the time since the print start timing of the sheet fed to the sheet feeding option last time is longer than the sheet feeding interval, the engine control part 203 checks whether the print start command is received or not (1214). Whereas if the time since the print start timing of the sheet fed to the sheet feeding option last time is shorter than the sheet feeding interval, the engine control part 203 waits till the time since the print start timing of the sheet fed to the sheet feeding option last time reaches the sheet feeding interval, the engine control part 203, and checks whether the print start command is received or not (1210).

The engine control part 203, in the case of judging in 1210 that the print start command is received, outputs the /TOP signal and continues the print operation (1210, 1203).

In the case of receiving only the sheet feeding interval designation command, the engine control part 203 compares a time since the print start timing of the sheet discharged to a sheet discharging option last time with a sheet discharging interval designated by a sheet discharging interval designation command (1206, 1207, 1215).

If the time since the print start timing of the sheet discharged to the sheet discharging option last time is longer than the sheet discharging interval, the engine control part 203 checks whether the print start command is received or not (1215). If the time since the print start timing of the sheet discharged to the sheet discharging option last time is shorter than the sheet discharging interval, the engine control part 203 waits till the time since the print start timing of the sheet discharged to the sheet discharging option last time reaches the sheet discharging interval, and checks whether the print start command is received or not (1210).

As discussed above, according to the image forming apparatus in the third embodiment, the futile downtime can be avoided by continuing the print operation without any interruption of the consecutive printing (without executing the post-rotation sequence) even in the case where the supplying port switchover in the multi-staged supplying option and the processing of the discharging option such as the changeover of discharging bins, stapling, bookbinding, etc. occur for the same transferring material.

Note that the third embodiment discussed above can be changed in a variety of forms based on the gist of the present invention, and these changes are not excluded from the scope of the invention.

Other Embodiments

A system or an apparatus is supplied with a storage medium stored with program codes of software for actualizing the functions in the embodiments discussed above, and a computer (or a CPU, MPU, etc.) of the system or the apparatus reads and executes the program codes stored on the storage medium, whereby the present invention is, as a matter of course, attained.

In this case, the program codes themselves read from the storage medium actualize the functions in the embodiments discussed above, and the storage medium stored with the program codes configures the present invention.

Further, the storage medium for supplying the program codes may be what can be stored with the program codes, such as a RAM, a NV-RAM, a floppy™ disk, a hard disk, an optical disk, a magneto-optic disk, a MO, a CD-ROM, a CD-R, a CD-RW, a DVD (DVD-ROM, a DVD-R, a DVD- RW, etc.), a magnetic tape, a nonvolatile memory card, other types of ROMs, etc., or can involve the use of downloading, etc. via a network.

Moreover, the computer executes the readout program codes, thereby actualizing the functions in the embodiments discussed above. Besides, based on instructions of the program codes, OS (Operating System), etc. running on the computer executes a part or the whole of the actual processing, and the present invention, as a matter of course, includes a case where the functions in the embodiments discussed above are actualized by the processing described above.

Still further, after the program codes read from the storage medium have been written to a memory provided in a function extended board inserted into the computer and in a function extended unit connected to the computer, the CPU, etc provided in the function extended board and in the function extended unit executes a part or the whole of the actual processing, and the present invention, as a matter of course, includes a case where the functions in the embodiments discussed above are actualized by the processing described above.

The variety of examples and embodiments of the present invention have been described so far, however, it is taken for granted to those skilled in the art that the gist and the scope of the present invention are not limited to the specific description and drawings in the present specification, and can extend to modifications and changes that are all described in the scope of claims of the present application.

What is claimed is:

1. An image forming apparatus comprising:

an engine control part for controlling an engine;

a controller part connected in a communicable manner to said engine control part;

print scheduling means for setting a schedule of a print operation for every material for recording from said controller part to said engine control part;

a recording material discharging device control part connected in the communicable manner to said controller part and serving to control a recording material discharging device for discharging the recording material to outside;

recording material discharging schedule operation means for setting a schedule of a recording material discharging operation from said controller part to said recording material discharging device control part;

recording material discharging interval notifying means for notifying said controller part of a recording material discharging interval till said recording material discharging device becomes receivable of the recording material next time when said recording material discharging schedule operation means sets the schedule of the recording material discharging operation for said recording material discharging device control part; and recording material discharging interval designation means for notifying said engine control part of information about the recording material discharging interval of which said recording material discharging interval notifying means has notified, from said controller part, wherein said engine control part sets the recording material discharging interval designated by said recording material discharging interval designation means as a recording material discharging interval from the recording material discharged by said recording material discharging device last time, and determines a print operation start timing in consideration of the designated recording material discharging interval and, in the case of performing the print operation for a different sheet discharging port after discharging the recording material to said recording material discharging device last time, a time expended for this print operation.

2. An image forming apparatus according to claim 1, wherein the recording material discharging interval designated by said recording material discharging interval designation means is effective in the recording material scheduled by said print schedule means after said recording material discharging interval designation means has designated the recording material discharging interval.

3. An image forming apparatus comprising:

an engine control part for controlling an engine;

a controller part connected in a communicable manner to said engine control part;

print scheduling means for setting a schedule of a print operation for every material for recording from said controller part to said engine control part;

a recording material supplying device control part connected in the communicable manner to said controller part and serving to control a recording material supplying device for supplying the recording material;

recording material supplying schedule operation means for setting a schedule of a recording material supplying operation from said controller part to said recording material supplying device control part;

recording material supplying interval notifying means for notifying said controller part of a recording material supplying interval till the recording material can be supplied next time when said recording material supplying schedule operation means sets the schedule of the recording material supplying operation for said recording material supplying device control part; and recording material supplying interval designation means for notifying said engine control part of information about the recording material supplying interval of which said recording material supplying interval notifying means has notified, from said controller part, wherein said engine control part sets the recording material supplying interval designated by said recording material supplying interval designation means as a recording material supplying interval from the recording material supplied from said recording material supplying device last time, and determines a print operation start timing.

4. An image forming apparatus according to claim 3, wherein the recording material supplying interval designated by said recording material supplying interval designation means is effective in the recording material scheduled by said print schedule means after said recording material supplying interval designation means has designated the recording material supplying interval.

5. An image forming apparatus comprising:

an engine control part for controlling an engine;

a controller part connected in a communicable manner to said engine control part;

print scheduling means for setting a schedule of a print operation for every material for recording from said controller part to said engine control part;

a recording material discharging device control part connected in the communicable manner to said controller part and serving to control a recording material discharging device for discharging the recording material to outside;

recording material discharging schedule operation means for setting a schedule of a recording material discharging operation from said controller part to said recording material discharging device control part;

recording material discharging interval notifying means for notifying said controller part of a recording material discharging interval till the recording material becomes receivable next time when said recording material discharging schedule operation means sets the schedule of the recording material discharging operation for said recording material discharging device control part;

recording material discharging interval designation means for notifying said engine control part of information about the recording material discharging interval of which said recording material discharging interval notifying means has notified, from said controller part;

a recording material supplying device control part connected in the communicable manner to said controller part and serving to control a recording material supplying device for supplying the recording material;

recording material supplying schedule operation means for setting a schedule of a recording material supplying operation from said controller part to said recording material supplying device control part;

recording material supplying interval notifying means for notifying said controller part of a recording material supplying interval till the recording material can be supplied next time when said recording material supplying schedule operation means sets the schedule of the recording material supplying operation for said recording material supplying device control part; and recording material supplying interval designation means for notifying said engine control part of information about the recording material supplying interval of which said recording material supplying interval notifying means has notified, from said controller part, wherein said engine control part determines a print operation start timing on the basis of the recording material supplying interval designated by said recording material supplying interval designation means and the recording material discharging interval designated by said recording material discharging interval designation means.

6. An image forming apparatus according to claim 5, wherein the recording material discharging interval designated by said recording material discharging interval designation means is effective in the recording material scheduled by said print schedule means after said recording material discharging interval designation means has designated the recording material discharging interval, and said engine control part sets the recording material discharging interval designated by said recording material discharging interval designation means as a recording material discharging interval from the recording material discharged by said recording material discharging device last time, and determines a print operation start timing in consideration of, in the case of performing the print operation for a different sheet discharging port after discharging the recording material to said recording material discharging device last time, a time expended for performing the print operation for the different sheet discharging port after discharging the recording material to said recording material discharging device last time and the designated recording material discharging interval.

7. An image forming apparatus according to claim 5, wherein the recording material supplying interval designated by said recording material supplying interval designation means is effective in the recording material scheduled by said print schedule means after said recording material supplying interval designation means has designated the recording material supplying interval.

8. An image forming apparatus according to claims 5, wherein if said recording material discharging interval designation means and said recording material supplying interval designation means designate the recording material discharging interval and the recording material supplying interval for the same recording material, said engine control part starts the print operation at a timing that meets both of conditions of the designated recording material discharging interval and of the designated recording material supplying interval.

9. An image forming apparatus according to claim 6, wherein if said recording material discharging interval designation means and said recording material supplying interval designation means designate the recording material discharging interval and the recording material supplying interval for the same recording material, said engine control part starts the print operation at a timing that meets both of conditions of the designated recording material discharging interval and of the designated recording material supplying interval.

10. An image forming apparatus according to claim 8, wherein if said recording material discharging interval designation means and said recording material supplying interval designation means designate the recording material discharging interval and the recording material supplying interval for the same recording material, said engine control part starts the print operation at a timing that meets both of conditions of the designated recording material discharging interval and of the designated recording material supplying interval.

11. An image forming apparatus comprising:

an image forming device;

a recording material processing apparatus which supplies a recording material to said image forming device or receives the recording material discharged from said image forming device;

a communication unit which gives designation of an execution of processing of recording material to said recording material processing apparatus, or receives interval information output from said recording material processing apparatus in response to the designation of the execution of the processing, the interval information being related to a time until which the recording material processing apparatus can supply or receive the recording material after a previous processing of recording material; and a control part for controlling recording material feed timing, wherein in a case where a next recording material which is designated to be supplied to or received from said recording material processing apparatus is going to be fed following the recording material in which the designation of the execution of processing is previously given, said control part controls a timing to feed recording material after the sheet feeding of the recording material in which the designation of the execution of processing is previously given after a time according to the interval information passes, and in a case where a next recording material which is not to be supplied to or received from said recording material processing apparatus is fed following the recording material in which the designation of the execution of processing is previously given, said control part controls a timing to allow feeding the next recording material before a time according to the interval information passes.

12. An image forming apparatus according to claim 11, wherein the recording material processing apparatus supplies stacked recording materials to said image forming apparatus sheet-by-sheet.

13. An image forming apparatus according to claim 11, wherein the recording material processing apparatus receives recording material discharge from said image forming apparatus.

14. An image forming apparatus according to claim 13, wherein the recording material processing apparatus staples the recording material which the recording material processing apparatus receives.

15. An image forming apparatus according to claim 11, wherein said image forming part includes an engine part and an image signal output part which outputs an image signal to said engine part.

16. An image forming apparatus according to claim 15, wherein said control part includes an engine control part included in the engine part and a controller part included in said image signal output part.

17. An image forming apparatus according to claim 16, wherein the interval information is transmitted from said controller part to said engine control part, wherein the engine control part, in a case that recording material which is to be supplied to or received from said recording material processing apparatus is fed with following the recording material to which the designation of the execution of processing is gave, controls a timing to feed recording material after the sheet feeding of the recording material to which the designation of the execution of processing is gave and a time according to the information interval, and wherein in a case that recording material which is not to be supplied to or received from said recording material processing apparatus is fed, with following the recording material to which the execution of processing is gave, said engine control part allows feeding of recording material before a time according to the information interval.

18. An image forming apparatus according to claim 17, wherein designation of print operation is respectively gave from the controller part to said engine control part for each of sheets of recording material, and the designation of print operation is effected after the interval information is transmitted to the engine control part.

19. An image forming apparatus according to claim 18, wherein, in a case that recording material which is not processed by said recording material processing apparatus after recording material which is to be supplied to or received from said recording material processing apparatus is fed, said engine control part controls a timing of feeding recording material which is to be supplied to or received from said recording material processing apparatus, based on the interval information and a time period in which print operation of the recording material not processed by said recording material processing apparatus.

* * * * *

UNITED STATES PATENT AND TRADEMARK OFFICE

CERTIFICATE OF CORRECTION

PATENT NO. : 7,190,916 B2
APPLICATION NO. : 10/790739
DATED : March 13, 2007
INVENTOR(S) : Ryuichi Yoshizawa It is certified that error appears in the above-identified patent and that said Letters Patent is hereby corrected as shown below:

ON THE TITLE PAGE:
At Item (57), Abstract, Line 13, "an" should read --a--.

IN THE DRAWINGS:
Sheet No. 6, Figure 5B, "(DISCHRGING" (both occurrences) should read --(DISCHARGING--.

COLUMN 1:
Line 7, "etc." should read --etc.,--.
Line 30, "part" should read --section--.

COLUMN 3:
Line 11, "headed," should read --headed--.
Line 33, "vide" should read --video--.
Line 34, "part 210," should read --part 204.--.

COLUMN 5:
Line 20, "start" should read --starts--.
Line 31, "option 206" should read --option 26--.
Line 54, "shows." should read --show.--.

COLUMN 6:
Line 23, "however," should be deleted.

COLUMN 7:
Line 31, "an" should read --a--.
Line 33, "etc." should read --etc.,--.

COLUMN 8:
Line 9, "etc." should read --etc.,--.

COLUMN 9:
Line 9, "has" should read --has been--.
Line 12, "an" should read --a--.
Line 14, "etc." should read --etc.,--.

COLUMN 10:
Line 33, "(which" should read --(which is--.

COLUMN 11:
Line 61, "etc." should read --etc.,--.

COLUMN 12:
Line 14, "material, the" should read --material. The--.
Line 24, "etc" should read --etc.,--.

COLUMN 13:
Line 53, "etc" should read --etc.,--.

COLUMN 14:
Line 7, "etc." should read --etc.,--.

COLUMN 16:
Line 13, "the engine control part 203," should be deleted.
Line 43, "etc." should read --etc.,--.

COLUMN 17:
Line 3, "etc." should read --etc.,--.
Line 7, "etc." should read --etc.,--.
Line 16, "etc" should read --etc.,--.

COLUMN 20:
Line 3, "claims" should read --claim--.
Line 23, "claim 8," should read --claim 7,--.

COLUMN 21:
Line 7, "discharge" should read --discharged--.
Line 28, "gave," should read --given,--.

COLUMN 22:
Line 2, "gave" should read --given--.
Line 7, "gave," should read --given,--.
Line 11, "gave" should read --given--.

Signed and Sealed this

Second Day of March, 2010

David J. Kappos

David J. Kappos
*Director of the United States Patent and Trademark Office*